US007064670B2

(12) United States Patent
Galperin et al.

(10) Patent No.: US 7,064,670 B2
(45) Date of Patent: Jun. 20, 2006

(54) METHOD AND APPARATUS FOR PORTABLE TRANSMITTING DEVICES

(75) Inventors: Natan Galperin, Zoran (IL); Lev Rusman, Lod (IL); Yoav Reisman, Ra'anana (IL); Guy Greitser, Haifa (IL); Gil Gemer, Nirit (IL)

(73) Assignee: DMATEK, Ltd., Tel Aviv (IL)

( * ) Notice: Subject to any disclaimer, the term of this patent is extended or adjusted under 35 U.S.C. 154(b) by 161 days.

(21) Appl. No.: 10/786,190

(22) Filed: Feb. 25, 2004

(65) Prior Publication Data

US 2005/0184870 A1 Aug. 25, 2005

(51) Int. Cl.
*G08B 23/00* (2006.01)

(52) U.S. Cl. ..... 340/573.4; 340/539.11; 340/539.13; 340/539.14; 340/539.31; 379/38

(58) Field of Classification Search ..... 340/539.11, 340/539.13, 539.14, 539.31, 573.4; 379/38
See application file for complete search history.

(56) References Cited

U.S. PATENT DOCUMENTS

| | | | | |
|---|---|---|---|---|
| 4,952,913 | A * | 8/1990 | Pauley et al. | 340/573.4 |
| 5,255,306 | A * | 10/1993 | Melton et al. | 379/38 |
| 5,504,474 | A | 4/1996 | Libman et al. | |
| 5,831,535 | A | 11/1998 | Reisman et al. | |
| 5,936,529 | A | 8/1999 | Reisman et al. | |
| 6,437,696 | B1 * | 8/2002 | Lemelson et al. | 340/573.4 |
| 6,639,516 | B1 * | 10/2003 | Copley | 340/573.4 |
| 6,853,304 | B1 * | 2/2005 | Reisman et al. | 340/573.4 |

* cited by examiner

*Primary Examiner*—Benjamin C. Lee
*Assistant Examiner*—Samuel J Walk
(74) *Attorney, Agent, or Firm*—Davidson, Davidson & Kappel, LLC

(57) ABSTRACT

A tag and method for use with a monitoring system, the tag having straps for attaching the tag to the limb of a person, a motion sensor for determining the motion of the person wearing the tag and a second sensor for detecting that the tag was tampered with, the information received from the tag can be identified as tamper alarms.

20 Claims, 8 Drawing Sheets

| Event Time (200) | message (202) | Severity (204) | STATUS (206) |
|---|---|---|---|
| 01:00:00 | CLIENT LOW ACTIVITY (212) | | NEW |
| 02:00:00 | CLIENT LOW ACTIVITY | | |
| 03:00:00 | CLIENT LOW ACTIVITY | | |
| 04:00:00 | CLIENT LOW ACTIVITY | | |
| 05:00:00 | CLIENT LOW ACTIVITY (222) | | |
| 06:00:00 | DAY MODE | | |
| 07:00:00 | (232) | (237) | |
| 08:00:00 | TX STRAP TAMPER (242) | VIOLATION (247) | NEW |
| 09:00:00 | TX BODY TAMPER | VIOLATION | NEW |
| 10:00:00 | (252) | (257) | |
| 11:00:00 | NO ACTIVITY | ALARM (267) | NEW |
| 11:05:00 | NO ACTIVITY | VIOLATION | |
| 12:00:00 | NO ACTIVITY | VIOLATION | |
| 13:00:00 | | | |
| 14:00:00 | | | |
| 15:00:00 | (277) | | |
| 16:00:00 | CLIENT LOW ACTIVITY | | NEW |
| 17:00:00 | CLIENT LOW ACTIVITY | | |
| 18:00:00 | | | NEW |
| 19:00:00 | | | |
| 20:00:00 | | | |
| 21:00:00 | | | |
| 22:00:00 | | | |
| 23:00:00 | (282) | | |
| 00:00:00 | NIGHT MODE | | NEW |
| 01:00:00 | | | |
| 02:00:00 | (292) | (297) | |
| 03:00:00 | CLIENT HIGH ACTIVITY | PROFILE CHANGE ALARM | NEW |
| 03:05:00 | CLIENT HIGH ACTIVITY | PROFILE CHANGE VIOLATION | |
| 04:00:00 | CLIENT HIGH ACTIVITY | PROFILE CHANGE VIOLATION | |
| 05:00:00 | CLIENT HIGH ACTIVITY | PROFILE CHANGE VIOLATION | |
| 06:00:00 | CLIENT HIGH ACTIVITY | PROFILE CHANGE VIOLATION | |
| 07:00:00 | CLIENT HIGH ACTIVITY | PROFILE CHANGE VIOLATION | |
| 08:00:00 | | | |
| 09:00:00 | | | |

210 220 230 240 250 260 270 280 290 300 215 239 249 259 279 289 299 307

FIG. 6

METHOD AND APPARATUS FOR PORTABLE TRANSMITTING DEVICES

BACKGROUND OF THE INVENTION

1. Field of the Invention

The present invention generally relates to electronic monitoring systems. More specifically the present invention relates to an improved portable transmitting device, known as Tag for enhancing tampering detecting capabilities. The present invention further relates to a three tamper resistant method and apparatus.

2. Discussion of the Related Art

Electronic monitoring systems for remote monitoring and supervising of moving objects, and in particular for monitoring persons, are known in the art. The advantages of employing such a system in a wide range of applications in a variety of fields, including security, law enforcement, medical and more are known.

In a case of distinguishably identified code, the reliability of the monitoring system depends on the ability of the system to identify the person being monitored. Using tags for monitoring criminal offenders, patients such as mental illness patients or Alzheimer patients or infectious diseases patients, children and a like may cause difficulties since the monitored person may disposed of the tag, interrupt the system normal operational mode or hand it to another person (deliberately in case of criminal offenders or by mistake in case of mental illness patients or children). Tags now available are equipped with tamper detection sensors in order to prevent tampering with the tag. Tamper detection sensors now available may be divided into two groups: a strap cut sensor and a body or proximity sensor. Presently no other types of tampers related sensors are employed or are used in tags.

U.S. Pat. Nos. 5,504,474, 5,831,535 and 5,936,529, all assigned to the present assignee and incorporated herein by reference, including drawings and references cited therein, disclose a tamper-resistant tag of the type described above, for use with monitoring systems.

Generally the known arrangements include sensors which detect whether the strap attaches the device to the subject's limb, whether the device placed against the subject's skin, whether the strap attaches the device to the subject's limb has been cut or whether the closure member which secure the strap ends has been broken. Although it is not easy to deceive both of the tamper detection sensors, it is possible that when the subject is outside a monitoring range during a non monitoring time period (which may be permitted), the subject could remove the monitoring device and reattach the monitoring device to himself, or to another before re-entering a monitored area, and thereby escape detection should the subject commit an offence.

The present invention overcomes the disadvantages of the present art by providing a new and novel tag having three tamper sensors. The present invention further provides a method for enhancing the monitoring and identifying a person's behavior through the use of the new tag. The present invention provides a method for identifying a person's through the use of the novel tag. Furthermore, the present invention provides benefits such as monitoring the behavior of the monitored subject and alert if a predetermined behavior is monitored while using the novel tag.

SUMMARY OF THE PRESENT INVENTION

The present invention regards a tag for use with a monitoring system, the tag having an identification code, the tag is placed within a housing, the tag comprising: a power supply, a central processing unit, at least one strap for attaching the tag to the limb of a person, a motion sensor for determining the motion of the person wearing the tag; a second sensor for detecting that the tag was tampered with, and a transmitter or a transceiver for transmitting a tamper signal to a remote monitoring unit. The tag further comprises a receiver for receiving data from the remote monitoring unit, said data including predetermined thresholds for the operation of the motion sensor and strap cut sensor. The transceiver is a radio frequency transceiver. The motion sensor is one of the following: a tilt sensor, an acceleration sensor, an angular sensor, an inclination sensor, a position sensor. The second sensor is a proximity sensor for detecting or the presence of a limb between the straps attached to the tag. The second sensor could be a strap cut sensor for detecting that at least one of the straps of the tag has been tampered with. The tampered with comprises a cut in or a removal of the strap. The proximity sensor is one of the following: a skin or a body temperature detector, a skin color detector, a body or a skin odor sensor, heart pulse, SpO2 or capacitance sensor.

In accordance with another aspect of the present invention there is provided a method for monitoring and detecting a monitored person's behavior for enhancing tamper detection capabilities, the method comprising the steps of examining at least one signal from an at least one tamper sensor located within the tag at predetermined intervals; processing the at least one signal to determine whether a tamper has occurred; transmitting a signal to a remote monitoring unit. The signal can be a tamper signal or an indication as to the monitored patient's behavior. The method can further comprise the step of determining if at least two tamper detection sensors transmit tamper signals. The tamper signal can be computed from the signal obtained by the apparatus of the present invention. The step of examining the signals of the at least one tamper sensor comprises examining the signal of a motion sensor. The step of examining the signal of the motion sensor comprises comparing the signal to predetermined motion level thresholds in order to determine whether the signal fits predetermined violation criteria. The step of examining the signal of the motion sensor can comprise updating and comparing the signal to a database which holds data to be compared. The step of examining the signals of all the tamper sensors can comprise examining the signal of the body or proximity sensor. The step of examining the signal of the body or proximity sensor can comprise comparing the signal to predetermined thresholds in order to determine if the measured signal reaches certain threshold. The step of examining the signals of all the tamper sensors can comprise examining the signal of the strap cut sensor. The step of examining the signal of the strap cut sensor can comprise comparing the signal to predetermined thresholds.

According to yet another aspect of the present invention there is provided a method for monitoring and detecting a monitored person's behavior for distinguishing between different monitored persons, the method comprising the steps of examining signals received from at least one motion sensor located within a tag strapped to the limb of a monitored person at predetermined intervals; processing the signals to determine a pattern of motion related behavior associated with the monitored person; storing the pattern of motion related behavior associated with the monitored person; and comparing the pattern of motion related behavior associated with the monitored person with a stored motion related behavior signal pattern. The method can further comprise the step of transmitting an indication signal to a remote monitoring unit. The stored motion related behavior signal pattern is stored prior to comparison or prior to obtaining new sensor readings. The stored motion related behavior signal pattern can be predetermined or decided upon by the user of the method. The signals can comprise at least one data unit, each data unit comprising the time and length of movement by the monitored person. The pattern of motion related behavior can be a series of data units comprising time and length of movement describing actions.

BRIEF DESCRIPTION OF THE DRAWINGS

The present invention will be understood and appreciated more fully from the following detailed description taken in conjunction with the drawings in which:

FIG. 6 is an example for a local monitoring system produced report, derived using a tag, comprising a motion sensor, in accordance with the preferred embodiment of the present invention.

DETAILED DESCRIPTION OF THE PREFERRED EMBODIMENTS

Figure 1:
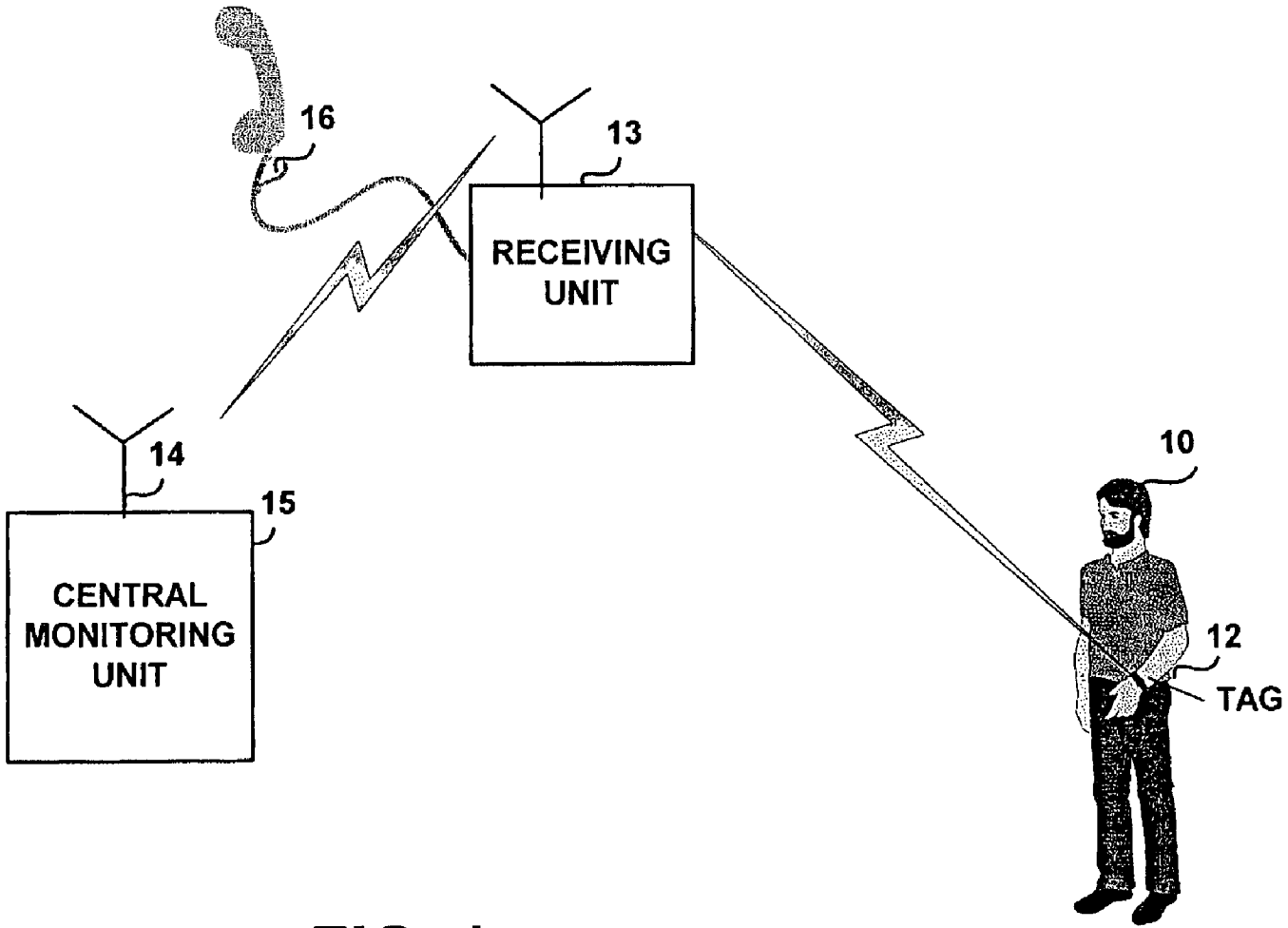
FIG. 1 is a pictorial representation of the system in which the apparatus and method of the present invention is operated.

The present invention relates to portable transmitting devices, known as tags mainly used as a part of electronic monitoring systems. A typical monitoring system comprises a plurality of portable transmitting devices, known as tags (one or more fixed or mobile), local monitoring unit and a central monitoring station. A tag is a device worn by a monitored person; the tag is capable of transmitting and receiving signals from a local monitoring unit. Each tag has an identification code. The identification code may be a unique code specific to the subject with whom the tag is associated, such that the subject can be distinguishably identified. Alternatively, the identification code may be a code typical to a certain group. The portable tag is usually strapped around a limb of the person being monitored. Current tags typically include a central processing unit (CPU) which enable programming the operation of the tag with regard to various parameters in order to meet the requirements specific to the subject to whom the tag is attached. Thus, parameters such as sampling intervals, data transmission intervals, monitored time periods, permitted and barred locations, thresholds for sending tamper signal and a like, can be selected according to specific needs. The tag periodically transmits corresponding signals, including the tag identification code and the tag's data. Those signals are to be received by one or more local monitoring units, wherein they are processed and optionally reported to the central monitoring station. A tamper signal is used in the context of this invention to indicate an attempted removal or removal of the tag from the person or an attempted removal or removal of the receiver from its location or an attempted removal or the removal of any part from of the tag from the tag or of the receiver from the receiver. In the context of the present invention a tamper also denotes that any part of the monitoring system including, but not limited to the tag, receiver or connection there between has been disturbed, discontinued, interfered with and the like. In the context of monitoring personal a tamper can denote any activity which is predetermined or any exception or deviation from a predetermined behavior or rules of behavior, including any deviation from a pattern of behavior and the like. Persons skilled in the art will appreciate that the use of the word tamper is intended in the widest possible manner in order to achieve the purposes of the present invention as are depicted in the drawings and associated description.

The present invention comprises a new and novel tag. The tag comprising a motion sensor in a combination of at least one additional tamper detection sensor which is not a motion tamper detection sensor. The combination of a motion temper detection sensor and another tamper detection sensor improves significantly the tampering detection capabilities. Typically, portable transmitting device, in which the novel present invention can be implemented, comprises a power supply, a housing, a CPU or a microprocessor, a strap, an RF transmitter and at least two tamper detection sensor one of which is not a motion sensor. Strap cut sensor and body or proximity sensor are two examples for tamper detection sensor, which can be used as the non motion sensors in association with the present invention thus, the combination of a motion sensor used as a tamper detection sensor in addition to one other tamper detection mechanism enhances the tamper detection capabilities of the tag. The present invention further provides a novel method for monitoring and detecting a monitored person's behavior through the use of the new tag. The use of a motion sensor as a tamper detection sensor enables enhanced tamper detection capabilities. For example detecting no movement from the motion sensor implies that the tag was removed from the monitored person without being detected by other means. Alternatively, if a person is not moving at all, which suggest that the monitored person may is incapacitated; the tag of the present invention will provide an indication through the use of the motion sensor, when presently existing tamper sensors would not.

It is another objective of the present invention to record and save the motion pattern of the monitored subject in order to distinguish between different monitored subjects and use it in a similar way to a fingerprint. In order to monitor and detect patterns and behavior of the monitored subject the additional motion sensor as well as its capabilities of detecting the monitored subject and behavior would likely prevent attempt to circumvent tamper detection means now available.

FIG. 1 a pictorial representation of the system in which the apparatus and method of the present invention is operated. A typical transmitting tag, such as tag 12 (detailed described in FIG. 2), worn by a monitored person 10, transmits signals to a monitored unit such as the home monitoring remote unit (HMRU) 13. Tag 12 can be implemented, as disclosed in U.S. Pat. Nos. 5,504,474, 5,831,535 and 5,936,529 incorporated herein by reference. Tag 12 is capable of transmitting signals to a variety of monitoring devices such as mobile unit (MU), pager, home monitoring unit, personal locating system (PLS), or any other monitoring unit. The HMRU 13 and like devices transmit the signal to a central monitoring unit 15 to be received by either wireless communication, such as RF antenna 14, or by conventional communication lines (wire or wireless) such as telephone lines 16, cable TV, WAN, LAN and a like, for further processing.

Figure 2:
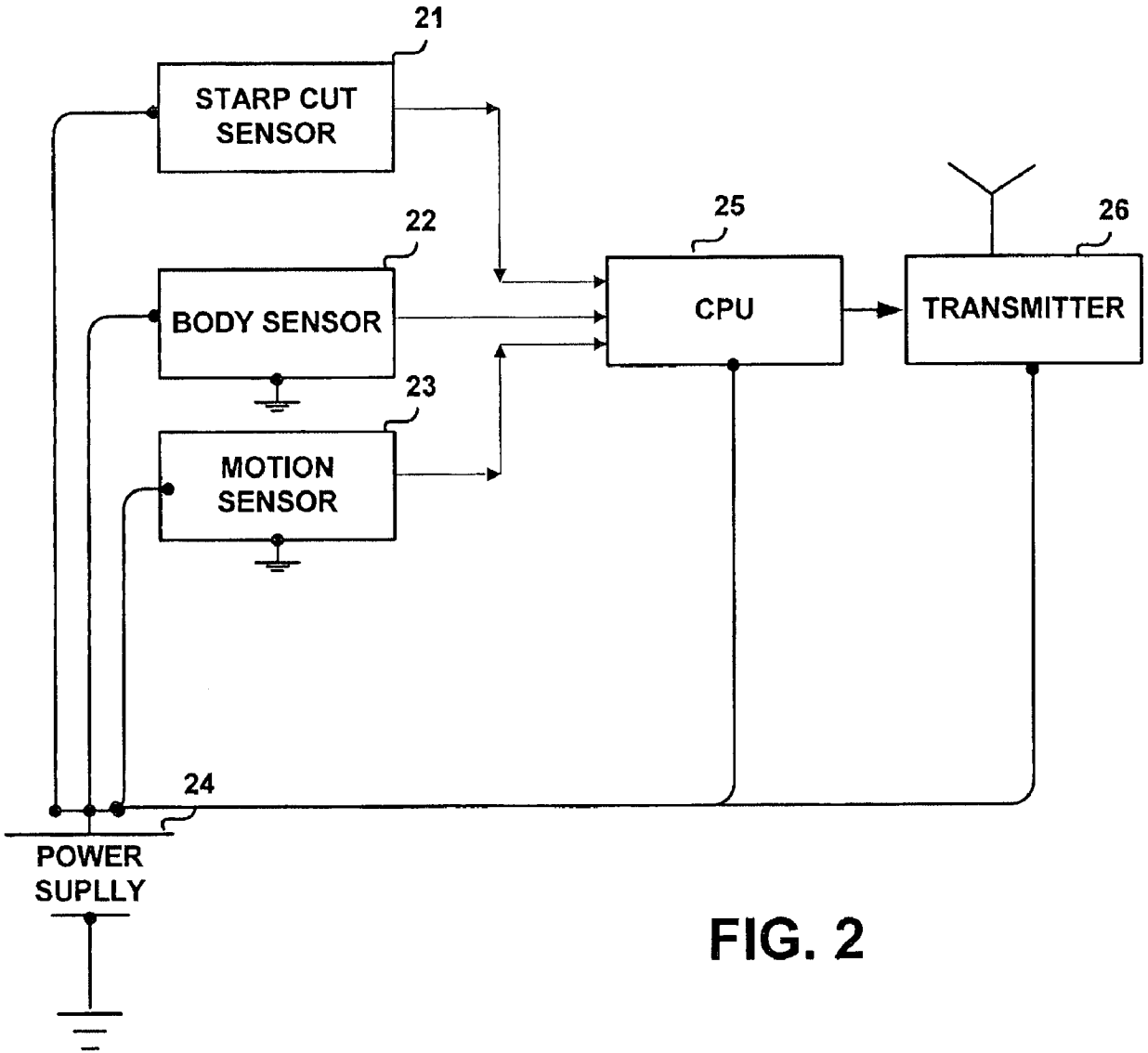
FIG. 2 illustrates a block diagram of the main components of the tag, in accordance with a preferred embodiment of the present invention.

FIG. 2 illustrates a block diagram of the main components of the tag, in accordance with a preferred embodiment of the present invention. Tag 12 in FIG. 1 comprises a power supply 24, a CPU or microprocessor 25, an RF transmitter 26, a motion detection sensor 23 and at least one other tamper detection sensor, such as a strap cut sensor 21, a body or proximity sensor 22 and a like. In other words, the tag may comprise one or more motion sensor 21 and one or more strap cut sensor 21, Alternatively, the tag may comprises one or more motion sensor 21 and one or more body or proximity sensor 22. An example for a strap cut sensor 21 operational principles are detailed described in FIG. 3A while an example for a body or proximity sensor 22 principles are detailed described in FIG. 3B. A proximity sensor is designed to detect the presence of a limb located within the straps of the tag. One proximity sensor contemplated by the present invention is a proximity sensor designed to detect capacitance transferred through the body of the monitored person. Capacitance is determined through detecting the existence of dielectric substance (such as the human body) between two plates of a capacitor which are part of the capacitance tamper sensor. Such capacitance sensor would preferably indicate the change in capacitance and provide an alert when the capacitance drops below or exceeds a predetermined threshold. Body proximity sensor can also include a temperature sensor, a skin color sensor, an optic sensor, a sensor sensing odor identified molecules or a sensor determining the resistance of the body located within the straps, heart rate sensor or a SpO2. A strap cut sensor is designed to detect an attempt to cut or sever either of the straps attached to the tag. A strap cut sensor can also detect the removal of an each strap while the tag still remains on the body. The strap cut sensor is preferably a strap cut sensor as described in U.S. Pat. No. 5,504,474 issued Apr. 2, 1996. Other like strap cut sensors may be utilized by the present invention. One such strap cut sensor can be a sensor detecting the absence of low current in the straps whereby such current is continuously circulated through the straps. An example for a motion sensor 23 operational principles is detailed described in FIG. 4. Each of the tamper detection sensors sends independently signals to the tag CPU 25 for processing. The CPU 25 periodically transmits corresponding signals, including the tag identification code and the sensor's data signals to a remote monitoring unit (not shown). CPU 25 is programmable by the operation of the tag with regard to various parameters in order to meet the requirements specific to the subject to whom the tag is attached. Thus, parameters such as sampling intervals, data transmission intervals, monitored time periods, different tampering parameters and limits, permitted and barred locations and a like, can be selected according to specific needs. Each of the three tamper detection sensors, the strap cut 21, the body 22 and the tilt 23 sends signals continuously or when needed to CPU 25. CPU 25 compares each signal to a predetermined threshold or checks signals parameters such as time interval between crossing the predetermined threshold, number of times crossing the threshold and a like in order to determine tamper detection per each sensor. CPU 25 then transmits the tamper detections to the remote monitoring unit (not shown) using transmitter 26. The remote monitoring unit, for example HMRU 13 in FIG. 1 further processes the information received from all the sensors and decides whether an attempt to circumvent tamper detection occurred. Alternatively, a tamper signal received by CPU 25 from motion sensor 23 in addition to at least one other tampering signal received from strap cut sensor 21 or from body or proximity sensor 22 will trigger CPU 25 to transmit to HMRU 13 in FIG. 1 the computed tamper signal. The computed tamper signal can include an indication of the tamper alert as well as the identification of the tag from which the tamper alert is issued. The tag by means of the CPU performs the interpretation of the signals, determines which decisions should be taken based upon predetermined rules and sends the alarm when generated and other data. Where the tag performs the decision determination or interpretation of signals received or when an alarm should be generated, the tag may also send all the information to the receiver unit or the remote location. The computed tamper signal may then be transmitted by HMRU 13 by conventional communication lines as described in FIG. 1 to a central monitoring station for future process and action. A single tamper signal received by CPU 25 from motion sensor 23 with no other signal from one of the other tamper detection sensors will not trigger CPU 25 to transmit a tamper signal but to transmit another predetermined signal. For example, high activity signal of prisoners during rests time, implying a tunnel excavation, illegal unionization and a like. Another example of a different predetermined signal may be, for example, low activity signal received from an old person in a medical care program during day time, suggest that the monitored person may be incapacitated or freezing during a cold day and a like. Furthermore, when security personnel sleep or is distressed during their line of work, their behavior which do not conform to the standards required can be detected using the novel tag having a motion sensor, by a comparison to a predetermined behaviors profile. In addition, a simple reading of the tag motion sensor can show non movement of lower activity by such an individual. The tag or any remote system thereto can than determine that the person is not moving sufficiently to perform his duties.

Figure 3A:
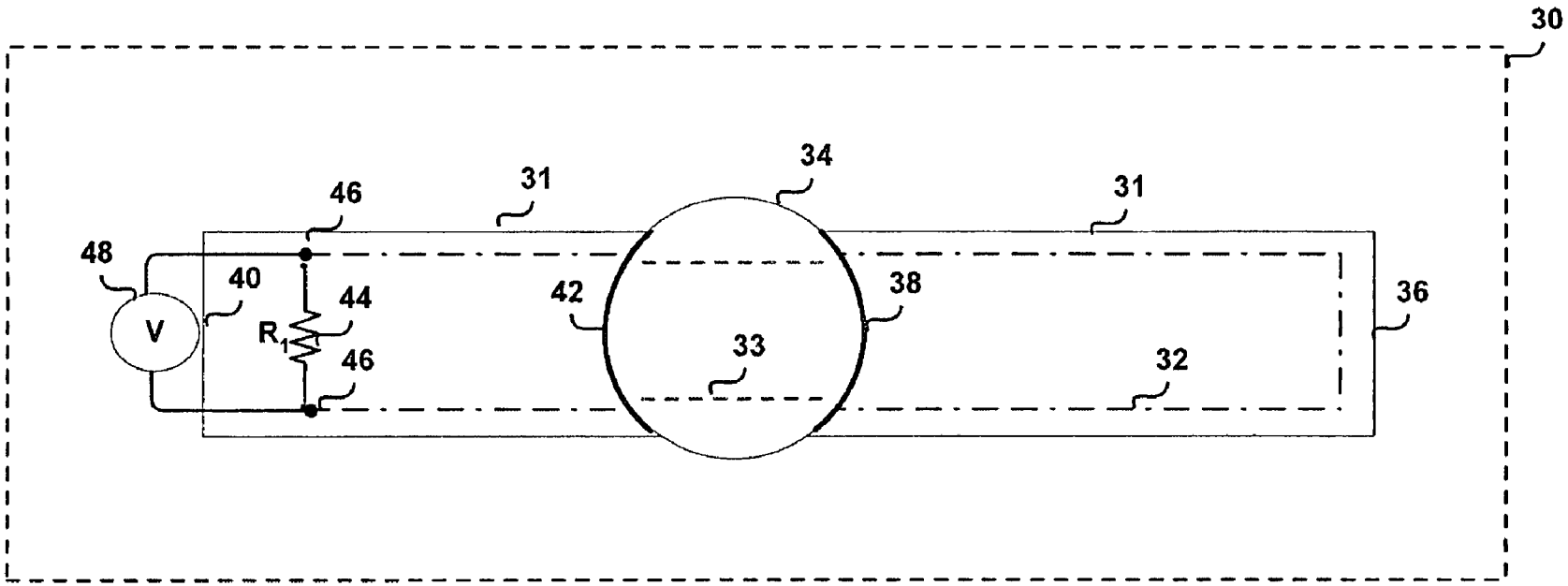
FIG. 3A illustrates an exemplary of a pictorial representation and a graph of a strap cut sensor, in accordance with the preferred embodiment of the present invention.

FIG. 3A illustrates an exemplary of a pictorial representation and a graph of a strap cut sensor, in accordance with the preferred embodiment of the present invention. Strap cut sensor 30 comprises two straps 31, a housing 34 and electrical circuitry (not shown). The first strap has a free end 36 and an end which is attached to the housing 38. The first strap also includes a first portion of an electrical circuit 32 and a plurality of longitudinally arranged pairs of first strap holes (not shown). The second strap has a free end 40 and an end which is attached to the housing 42, the second strap also includes the second portion of the electrical circuit 32 being electrically connected to the first portion of the electrical circuit through the housing 33 and at least two pairs of longitudinally arranged second strap holes corresponding to the first strap holes (not shown). The second strap further includes at least one pair of contacts 46 corresponding to the first strap holes, each of the contacts electrically connected to one end on the circuit, the contacts being located between the second strap holes.

These two straps are connected together by a mechanically and electrically connecting and locking means in order to attach the housing around the limb of the object being monitored so as to form a circuit with resistivity which is electrically continuous except that the circuit is electrically open near the free end 40 of the second strap. The resisitivity $R_1$ 44 is being measured continuously in a predetermined time intervals (for example few microseconds) by measuring the voltage V 48 falling between pair of contacts 46 of the second strap. The measured voltage as a function of the sampling time increases until a certain level 52 is reached. In case of no tampering the voltage will remain between V1 and V2 until the next sampling cycle.

Figure 3B:
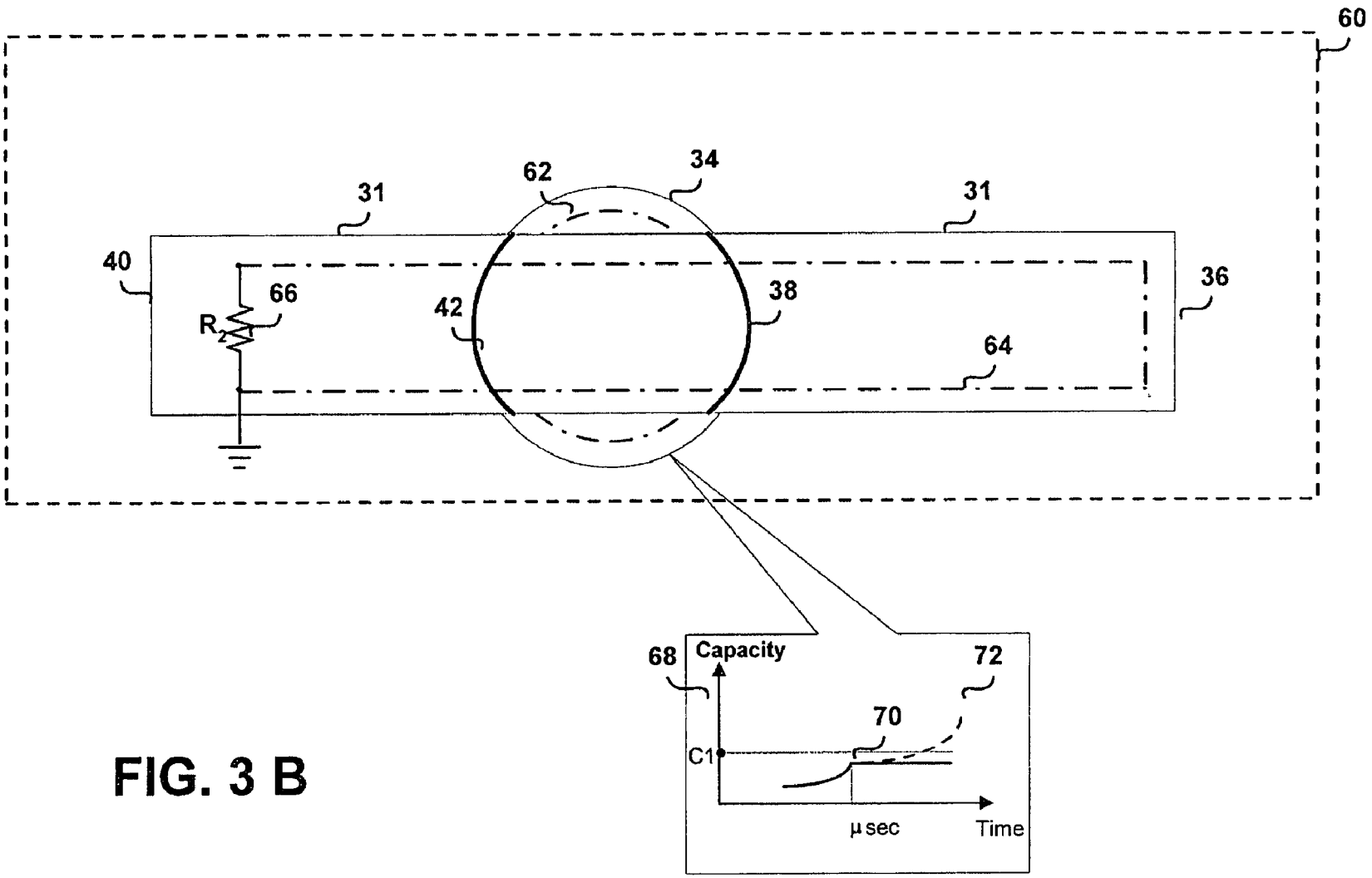
FIG. 3B illustrates an exemplary of a pictorial representation and a graph of a body or proximity sensor, in accordance with the preferred embodiment of the present invention.

FIG. 3B illustrates an exemplary of a pictorial representation and a graph of a body or proximity sensor, in accordance with the preferred embodiment of the present invention. Body or proximity sensor 60 comprises two straps 31, a housing 34 and electrical circuitry (not shown). The two straps have a free end 36 and 40 and an end which is attached to housing 36 and 42. In addition, both straps are being connected to electrical circuit 64. These two straps are connected together by a mechanically and electrically connecting and locking means in order to attach the housing around the limb of the object being monitored so as to form a circuit with resistivity $R_2$ 66.

Electrical circuit 64 is grounded with reference to power supply 24 in FIG. 2 while another portion of electrical circuit 62, positioned at housing 34 is electrically isolated from electrical circuit 64. The electrical circuitry (not shown) comprises a standard oscillator in order to convert the measured capacitance between electrical circuit 64 and electrical circuit 62 into frequency. A frequency counter (part of the electrical circuitry which is not shown) is being used in order to determine the capacitance. A person skilled in the art would identify low number of pulses as low capacity and high number of pulses as high capacity. Similarly to the strap cut sensor the capacitance C 68 is being measured continuously in a predetermined time intervals (for example few microseconds) by counting the number of pulses that are being counted by a frequency counter. The measured capacitance 68 as a function of the sampling time increases until a certain level 70 is reached. In case of no tampering the capacity will reach above C1 until the next sampling cycle. In case the monitored person has tampered with the strap, for example cut or remove the strap, the capacity would not reach C1 70. In case of cutting or removing the strap while the tag is present in an electrical conducting environment, such as conducting solution, capacitance would further increase above C1 72. To conclude, if the capacity does not reach a predetermined level C1 70, after a predetermined time, the body or proximity sensor will send tamper signal to CPU 25 in FIG. 2.

It will be easily appreciated by persons skilled in the art that other types of body or proximity, such as skin or body temperature detector, skin color detector, body or skin smell sensor and a like, may be used as well.

Figure 4:
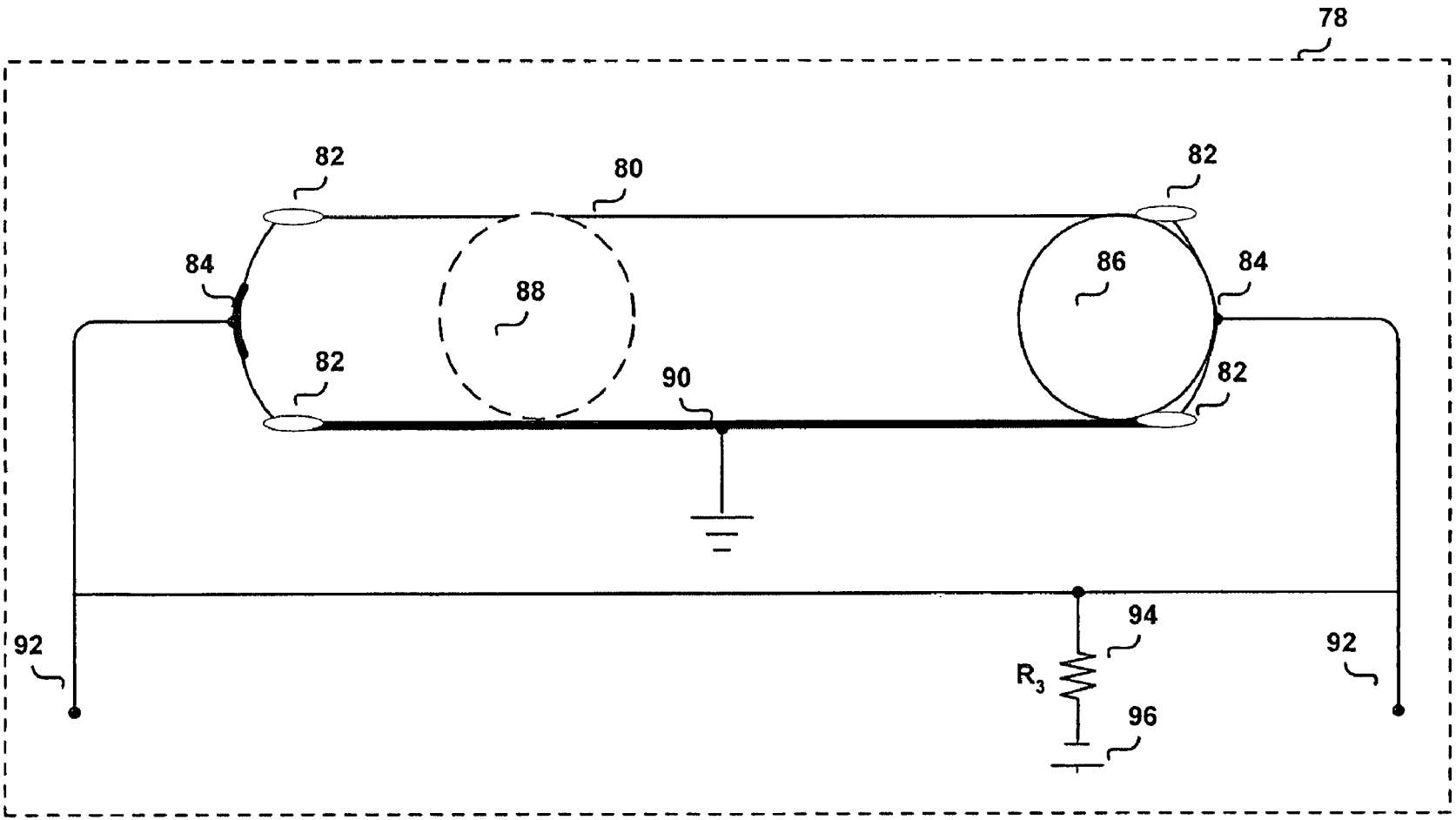
FIG. 4 illustrates example of a pictorial representation of a motion sensor, in accordance with the preferred embodiment of the present invention.

FIG. 4 illustrates example of a pictorial representation of a motion sensor, in accordance with the preferred embodiment of the present invention. Motion sensor is a detector that has the ability to detect motions of the monitored object to which the motion sensor is attached. It will be easily appreciated by persons skilled in the art that tilt sensors, acceleration sensors, angular sensor, inclination sensors, position sensors and a like, can be all used separately as a motion sensor. Motion sensor can be CW 1620-3 tilt sensor manufactured by the Comus Group of companies consist of Assemtech Europe Limited, E. Bachem GmbH, W. Gunther GmbH, Gunther Belgium, Gunther France, S.T.G. Motion sensor can also be ADXL202/ADXL210 acceleration sensor manufactures by Analog Devices Inc. of USA. Persons skilled in the art will appreciate that any combination of at least two sensors of the same kind comprises together, or at least two different sensors comprises together can be used as a motion sensor.

A simple, relatively cheap, low power consumption of a motion sensor is a tilt sensor. Tilt sensor 78 comprises an electrically conductive outer surface ball placed inside a sealed tube 80 preferably vacuumed of filled with inert gas such as nitrogen and a like. The two conductive ends of the tube 84 are connected to electrodes 92. The body of tube 80 is grounded and electrically isolated 82 from the conductive ends of the tube 84. Tilt sensor 78 also comprises an electrically circuitry comprises of a resistivity $R_3$ 94 and a power supply 96. Conductive ball 86 can touch one of the conductive ends of the tube 84 or can be positioned 88 without touching the conductive ends of the tube 84. If conductive ball 86 touches one of the conductive ends 84, the conjugate electrode 92 is than grounded. If conductive ball 88 does not touch one of the conductive ends 84, the conjugate electrode 92 receives power supply 96. The measured voltage of electrodes 92 versus time, would changed to ground in accordance with the number of time conductive ball 88 moves from the middle of tube 80 to a position in which the conductive ball 86 touches one of the conductive ends 84. While the monitored subject moves the tilt sensor, the conductive ball 88 moves as well, forming the voltage changes measured at electrodes 92.

Figure 5:
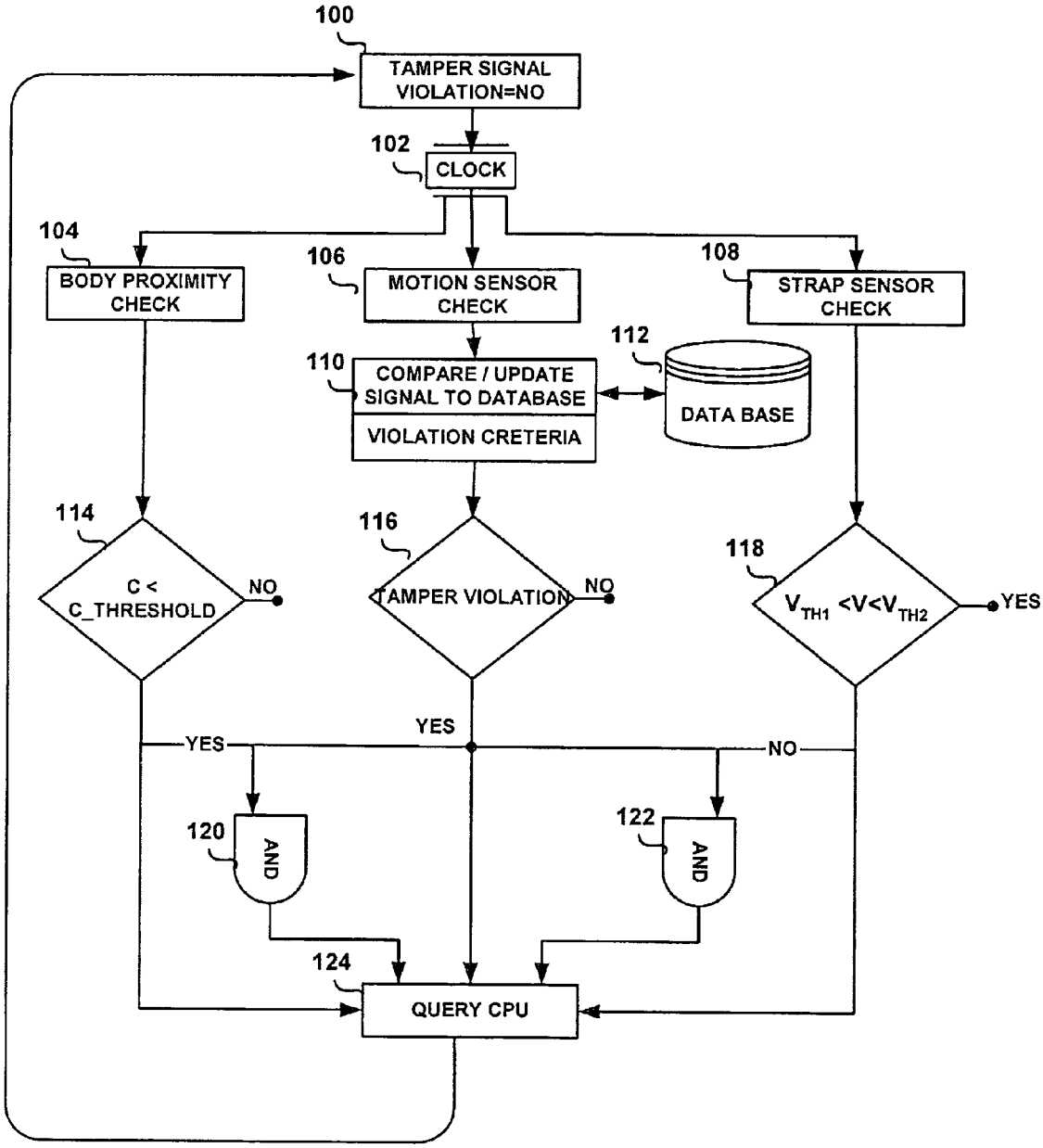
FIG. 5 is a flow chart depicting the main steps of controlling a tag, in accordance with the present invention.

FIG. 5 is a flow chart depicting the main steps of controlling a tag, in accordance with the present invention. The system default tamper signal 100 is indication of no tampering. The system triggers independently, by the use of clock 102, all the tamper sensors which exist in the tag to check their signals within predetermined intervals. The signal of the motion sensor is being checked at step 106. The signal is then further compared by CPU 25 in FIG. 2 or by the HMRU 13 in FIG. 1 to predetermined thresholds 110 in order to determine whether the signal fits predetermined violation criteria. Alternatively, motion sensor 23 in FIG. 2 updates and compares the signal to database 112 which is updated on line or may be preprogrammed. The motion sensor signal is then further processed to determine whether a tamper violation or a tamper alarm has occurred 116. If no, CPU 25 in FIG. 2 is updated. If so, the CPU or the HMRU then verifies if at least one other sensor detected tamper signal.

The signal of the body or proximity sensor is being checked in step 104 in order to compare the signal by CPU 25 in FIG. 2 or by the HMRU 13 in FIG. 1 to predetermined thresholds 114. If the measured signal reaches certain threshold 70 in FIG. 3B, CPU 25 in FIG. 2 is updated. If the measured signal does not reach the threshold, the CPU or the HMRU then checks if the motion sensor detected tamper signal.

The signal of the strap cut sensor is being checked in step 108 in order to compare voltage signal 48 in FIG. 3A by CPU 25 in FIG. 2 to predetermined thresholds 118. The threshold can be programmed and changed and transmitted to the tag when necessary. If the measured signal reaches after a predetermined time to a certain level 52 in FIG. 3A between two predetermined thresholds, CPU 25 in FIG. 2 is updated. If the measured voltage is smaller than the smaller threshold V1 or higher than threshold V2 the CPU or the HMRU then verifies if the motion sensor detected tamper signal. The logical gates 120 and 122 examine if at least another tamper signal occurred in conjugation with a tamper signal from the motion sensor. The tag's CPU may transmit a computed tamper signal or an alarm signal to the HMRU if at least two tamper detection sensors send tamper signals.

Alternatively the CPU or the HMRU may transmit an alarm or tamper signal from each sensor independently according to needs. The system is then reset to a no tamper condition 100 before a new time interval sampling.

Thus, the system of the present invention enables the monitoring and detecting of a monitored person's behavior and distinguishing between different monitored persons. As shown above, the method further includes examining signals received from a motion sensor located within a tag strapped to the limb of a monitored person at predetermined intervals, processing the signals to determine a pattern of motion related behavior associated with the monitored person, storing the pattern of motion related behavior associated with the monitored person, and comparing the pattern of motion related behavior associated with the monitored person with a stored motion related behavior signal pattern. The stored motion related behavior signal pattern can be previously or later stored. Such pattern can be the basis for comparison between signals collected in real time and previously stored signals which indicate a particular behavior. For example, a period wherein the signals indicate little or no movement can be stored and defined as a period of sleep or deep sleep. The stored motion related behavior signal pattern can be predetermined. For example, a previously detected and recorded signal pattern from one person can be stored and compared with the signal pattern of another person. The signals can include one or more data units; each data unit can include the time and length of movement by the monitored person. The data unit can also include the average or median repetition rate and the total number of movements, the acceleration rate (with the aid of acceleration type sensors) and the like. The pattern of motion related behavior can also be a series of data units comprising time and length of movement describing actions. For example, it can be determined that a series of data units having particular input comprise a specific action. The system and method of the present invention can then compare movements of the monitored person as compared to known actions.

FIG. 6 is an example for a local monitoring system produced report, derived using a tag, comprising a motion sensor, in accordance with the preferred embodiment of the present invention. The report includes basic information (not shown) regarding the monitored person such as age, sex, name or identification tag and a like. In addition, the report includes a list of events recorded by the system. Such a list may comprise event time 200 which indicate the time at which a certain event occurred, message 202 summarizing the event, severity 204 of the event and status 206 of the event which may indicate if the event is new or not and the like. The following comprises an example of statuses and events generated by the apparatus and method of the present invention. Persons skilled in the art will appreciate that the following example is not restrictive and serves to better define and describe the present invention to the person skilled in the art.

At event time 01:00 (210) CPU 25 of FIG. 2 or by HMRU 13 of FIG. 1 detected low activity. Message 212 declares client low activity. Since such declaration was not declared previously, status 206 declares new status 215. The system declares messages according to predetermined thresholds or patterns or other preprogrammed data. Each status declared is the status of the system and/or tag and would be so reported. At 06:00 (220), the system declares day mode 222. Day mode may be declared when a certain activity was detected after a predetermined period of low activity, it may also be declared in accordance with predetermined times obtained from a clock device which may added to the apparatus of the present invention. At 08:00 (230) the system declares TX strap tamper 232 for indicating that the cut strap sensor sent a tamper signal. Severity is being reported as violation 237 indicating a violation of at least one of the preprogrammed parameters. The status is being reported as new 239. At 09:00 (240) the system declares TX body tamper 242 for indicating that the body or proximity sensor sent a tamper signal. Severity is being reported as violation 247 and the status is being reported as a new status 249. At 11:00 (250), the system detected an activity below a predetermined threshold and declared no activity status 252. Since the no activity status is a new event 259 severity is defined as an alarm status 257 and not as a violation status just yet. After a predetermined time interval, such as few minutes, another low activity detection occurs 260, and this declaration may be interpreted by the system as a violation status 267. Violation status declaration is defined in accordance with predetermined parameters or thresholds, preprogrammed or on line updated. At 00:00 (280) the system declares night mode 282 for indicating that the monitored person activity decreased below a certain threshold. Status 206 declares new event 289. At 03:00 (290) the system detected and declares client high activity status 292. Since the client high activity just received is a new event 299 the severity determined is that of an alarm status 297 (and not violation status). A profile change alarm may indicate that the predetermined parameters such as thresholds, profile patterns and a like, preprogrammed or on line updated are not the same while comparing to system database 112 in FIG. 5. After a predetermined time interval such as few minuets 300 the detected activity is again being compared to the system profile database. If there is no change in the status being declared, profile change violation status is declared 307 and the alarm is raised. Profile change violation declaration implies that the monitored person hand the tag to a different person trying to deceive the three tampers novel tag.

Figure 7:
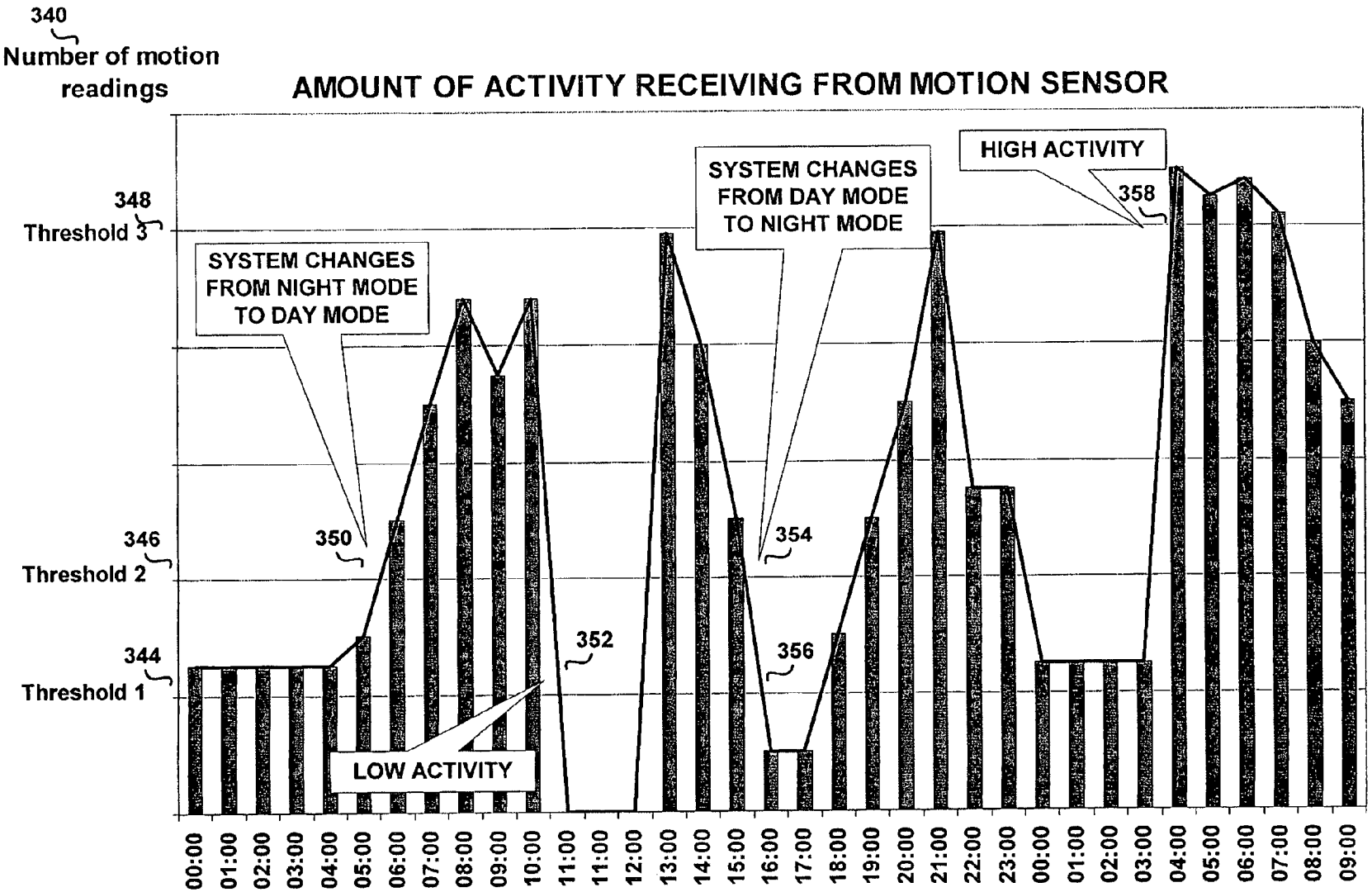
FIG. 7 is an example for a local monitoring system produced graph, presenting the number of tilt versus time of measurement, derived using a tag, comprising a motion sensor, in accordance with the preferred embodiment of the present invention.

FIG. 7 is an example for a local monitoring system produced graph, presenting the number of tilt versus time of measurement, derived using a tag, comprising a motion sensor, in accordance with the preferred embodiment of the present invention. Number of tilts 340 is plotted as a function of the time of which the monitored person is monitored. In order to distinguish between low activity, high activity, day mode, night mode and a like few thresholds 344, 346, 348 may be defined. Threshold 1 (344) is defined as number of tilts below which no activity message 252 in FIG. 6 is declared. Threshold 1 should be defined so that even low number of tilts, during low activity of the monitored person for example during night mode, still be higher than threshold 1. Threshold 2 (346) is defined so that any number of tilts above threshold 2 imply entering into a day mode. For example at 6:00 the number of tilts is higher than threshold 2 (350) and the system is changing from a night mode into a day mode. The tag further monitors the subject and at 11:00 (352) the number of tilts decreases below threshold 1 (344) and the system declares low activity. After a predetermined time interval, if no activity continues the system declares violation. After approximately one hour, number of tilts 340 increases as time goes on. At 16:00 (354) the number of tilts is lower than threshold 2 (350) and the system is changing from a day mode into a night mode. The tag further monitors the subject and at 16:00 (356) the number of tilts decreases below threshold 1 (344) and the system declares low activity again.

Threshold 3 (348) is defined as number of tilts above which high activity message 292 in FIG. 6 is declared.

Threshold 3 should be defined so that only very high number of tilts, during an extent activity of the monitored person would be higher than threshold 3. It will be easily appreciated by persons skilled in the art that other types of thresholds or other parameters can be used as well in order to define new declaration of the system, in order to define a private and distinguishable profile of a monitored person and a like. At 4:00 (358), the number of tilts is higher than threshold 3 and the system declares high activity. In addition, the system compares the tilts profile to system database 112 in FIG. 5 in order to find differences between the two. It is appreciated by person skilled in the art that there is a difference between the profile between 0:00 to 09:00 of the left hand side of FIG. 7 to the profile between 0:00 to 09:00 of the right hand side of FIG. 7. The system then declares profile change violation status 307 as explained in FIG. 6.

The person skilled in the art will appreciate that what has been shown is not limited to the description above. The person skilled in the art will appreciate that examples shown here above are in no way limiting and are shown to better and adequately describe the present invention. Those skilled in the art to which this invention pertains will appreciate the many modifications and other embodiments of the invention. It will be apparent that the present invention is not limited to the specific embodiments disclosed and those modifications and other embodiments are intended to be included within the scope of the invention. Although specific terms are employed herein, they are used in a generic and descriptive sense only and not for purposes of limitation. Persons skilled in the art will appreciate that the present invention is not limited to what has been particularly shown and described hereinabove. Rather, the scope of the present invention is defined only by the claims, which follow.

We claim:

1. A tag having enhanced tamper detection capabilities for use with a monitoring system, the tag having an identification code, the tag is placed within a housing, the tag comprising:

a power supply, a central processing unit, at least one strap for attaching the tag to the limb of a person, a motion sensor for determining pattern of the motion of the person wearing the tag wherein the pattern of motion so determined being compared with a stored pattern of motion for determining whether the tag was tampered with;

a second sensor for detecting whether the tag was tampered with, and a transmitter for transmitting a tamper signal to a remote monitoring unit.

2. The tag of claim 1 further comprising a receiver for receiving data from a remote monitoring unit, said data including predetermined thresholds for the operation of the motion sensor and the second sensor.

3. The tag of claim 1 wherein the transmitter is a radio frequency transmitter.

4. The tag of claim 1 wherein a motion sensor is one of the following: a tilt sensor, an acceleration sensor, an angular sensor, an inclination sensor, a position sensor.

5. The tag of claim 1 wherein the second sensor is a proximity sensor for detecting the presence of a limb between the straps attached to the tag.

6. The tag of claim 1 wherein the second sensor is a strap cut sensor for detecting that at least one of the straps of the tag has been tampered with.

7. The tag of claim 6 wherein tampered with comprises a cut in or a removal of the strap.

8. A method for monitoring and detecting a monitored person's behavior for distinguishing between different monitored persons, the method comprising the steps of:

examining signals received from at least one motion sensor located within a tag strapped to the limb of a monitored person at predetermined intervals;

processing the signals to determine a pattern of motion related behavior associated with the monitored person;

storing the pattern of motion related behavior associated with the monitored person; and comparing the pattern of motion related behavior associated with the monitored person with a motion related behavior signal pattern.

9. The method of claim 8 wherein the step of comparing comprises the comparison of motion related behavior associated with the monitored person with a stored motion related behavior signal pattern.

10. The method of claim 8 wherein the step of comparing is performed in the tag.

11. The method of claim 8 wherein the step of comparing is performed in a remote monitoring unit.

12. The method of claim 8 further comprising the step of transmitting an indication signal to a remote monitoring unit.

13. The method of claim 8 wherein the stored motion related behavior signal pattern was previously stored.

14. The method of claim 8 wherein the stored motion related behavior signal pattern is predetermined.

15. The method of claim 8 wherein the signals received from a motion sensor comprise at least one data unit, each data unit comprising the time and length of movement by the monitored person.

16. The method of claim 8 wherein the pattern of motion related behavior is a series of data units comprising time and length of movement describing actions.

17. The method of claim 8 further comprising a step of examining a signal received from a body or proximity sensor.

18. The method of claim 17 wherein the step of examining the signal of the body or proximity sensor comprises comparing the signal to predetermined thresholds.

19. The method of claim 8 further comprising a step of examining a signal received from a strap cut sensor.

20. The method of claim 19 wherein the step of examining the signal of the strap cut sensor comprises comparing the signal to predetermined thresholds.

* * * * *

UNITED STATES PATENT AND TRADEMARK OFFICE

CERTIFICATE OF CORRECTION

PATENT NO. : 7,064,670 B2
APPLICATION NO. : 10/786190
DATED : June 20, 2006
INVENTOR(S) : Natan Galperin et al.

It is certified that error appears in the above-identified patent and that said Letters Patent is hereby corrected as shown below:

Column 12, line 58, insert the following claim:

21: The tag of claim 5 wherein the proximity sensor is one of the following: a capacitance sensor, a skin or body temperature detector, a skin color detector, a body or a skin odor sensor, heart pulse detector, SpO2 detector, skin humidity sensor, trans dermal blood alcohol sensor.

Signed and Sealed this

Twelfth Day of December, 2006

JON W. DUDAS
*Director of the United States Patent and Trademark Office*